United States Patent [19]

Enomoto et al.

[11] 4,256,821

[45] Mar. 17, 1981

[54] ELECTROPHOTOGRAPHIC ELEMENT WITH CARBAZOLE-PHENYHYDRAZONE CHARGE TRANSPORT LAYER

[75] Inventors: Takamichi Enomoto, Shiroyama; Tatuya Katoh, Numazu; Akio Kozima, Hiratsuka; Tatsumi Satoh, Musashino, all of Japan

[73] Assignee: Ricoh Company, Ltd., Tokyo, Japan

[21] Appl. No.: 102,591

[22] Filed: Dec. 12, 1979

[30] Foreign Application Priority Data

Dec. 21, 1978 [JP] Japan ..... 53-158280

[51] Int. Cl.[3] ..... G03G 5/06; G03G 5/14

[52] U.S. Cl. ..... 430/59; 430/58; 430/79; 260/160; 260/174; 260/315

[58] Field of Search ..... 430/58, 59, 79

[56] References Cited

U.S. PATENT DOCUMENTS

| | | | |
|---|---|---|---|
| 3,884,691 | 5/1975 | Rolhlitz | 430/58 |
| 3,977,870 | 8/1976 | Rolhlitz | 430/59 |
| 4,134,761 | 1/1979 | Okazaki et al. | 430/59 |
| 4,150,987 | 4/1979 | Anderson et al. | 430/58 |
| 4,192,677 | 3/1980 | Okazaki et al. | 430/59 |

*Primary Examiner*—Roland E. Martin, Jr.
*Attorney, Agent, or Firm*—Blanchard, Flynn, Thiel, Boutell & Tanis

[57] ABSTRACT

The present invention provides a layered electrophotographic element which comprises an electroconductive support on which there is a charge generating layer and a charge transfer layer in order, said charge generating layer being consisted essentially of a charge generating agent expressed by the general formula I -continued

[wherein A represents or (wherein X is selected from the group consisting of benzene ring, naphthalene ring, indole ring, carbazole ring, benzofuran ring and substitutes thereof, $Ar_1$ is selected from the group consisting of benzene ring, naphthalene ring, dibenzofuran ring, carbazole ring and substitutes thereof, $Ar_2$ and $Ar_3$ are selected from the group consisting of benzene ring, naphthalene ring and substitutes thereof, $R_1$ and $R_3$ are selected from the group consisting of hydrogen, lower alkyl group, phenyl group and substitutes thereof and $R_2$ is selected from the group consisting of lower alkyl group, carboxyl group and alkyl esters thereof)], said charge transfer layer being consisted essentially of a charge transfer agent expressed by the general formula II (wherein $R_1$ represents methyl, ethyl, 2-hydroxyethyl or 2-chloroethyl group and $R_2$ represents methyl, ethyl, benzyl or phenyl group) and polycarbonate.

15 Claims, No Drawings

ELECTROPHOTOGRAPHIC ELEMENT WITH CARBAZOLE-PHENYHYDRAZONE CHARGE TRANSPORT LAYER

BACKGROUND OF THE INVENTION (a) Field of the Invention

The present invention relates to a layered electrophotographic element comprising a charge generating layer consisting essentially of a charge generating agent composed of a specific disazo pigment and a charge transfer layer consisting essentially of a charge transfer agent composed of a specific carbazole derivative and a specific binder.

(b) Description of the Prior Art

Layered electrophotographic elements of the type of comprising an electroconductive support on which there is formed in turn a charge generating layer and a charge transfer layer, said charge generating layer being consisted essentially of a charge generating agent such as monoazo pigment, disazo pigment or the like, said charge transfer layer being consisted essentially of a charge transfer agent such as fluorenone derivative, carbazole derivative or the like and a resin binder of every kind, are well known. In such multi-layered electrophotographic elements as mentioned above, their electrostatic characteristics depend mainly on the basic materials used, namely the combinations of charge generating agents with charge transfer agents, while their mechanical characteristics and physical properties such as surface property, external appearance and the like depend mainly on the binders incorporated in the charge transfer layers. Preferably, these properties should be neither changed nor deteriorated with the lapse of time or owing to their repeated use. In the case where durability is demanded of these properties, however, it is to be noted that the binders contained in the charge transfer layers tend to exert a great influence thereupon. In order to obtain the layered electrophotographic elements having durability as well as electrostatic characteristics, mechanical characteristics and physical properties, importance should be attached to selection of not only the basic materials but also the binders to be used. However, conventional layered electrophotographic elements could not meet all these properties simultaneously.

SUMMARY OF THE INVENTION

The object of the present invention is to provide a layered electrophotographic element which can practically satisfy the proposed electrostatic characteristics, mechanical characteristics, physical properties and durability.

That is, the layered electrophotographic element according to the present invention is characterized in that it comprises an electroconductive support on which there is a charge generating layer and a charge transfer layer in order, said charge generating layer being consisted essentially of a charge generating agent expressed by the general formula I

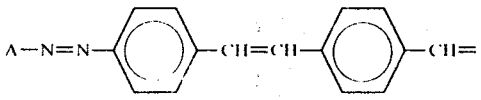

-continued

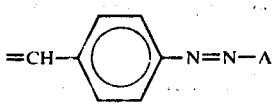

[wherein A represents

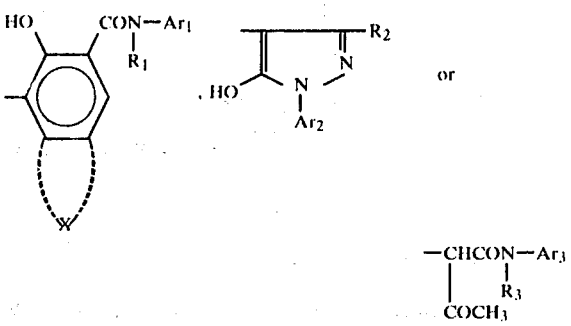

(wherein X is selected from the group consisting of benzene ring, naphthalene ring, indole ring, carbazole ring, benzofuran ring and substitutes thereof, $Ar_1$ is selected from the group consisting of benzene ring, naphthalene ring, dibenzofuran ring, carbazole ring and substitutes thereof, $Ar_2$ and $Ar_3$ are selected from the group consisting of benzene ring, naphthalene ring and substitutes thereof, $R_1$ and $R_3$ are selected from the group consisting of hydrogen, lower alkyl group, phenyl group and substitutes thereof and $R_2$ is selected from the group consisting of lower alkyl group, carboxyl group and alkyl esters thereof)], said charge transfer layer being consisted essentially of a charge transfer agent expressed by the general formula II

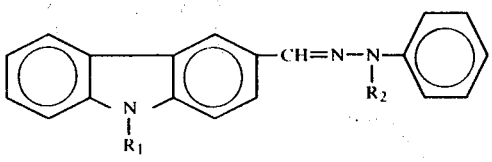

(wherein $R_1$ represents methyl, ethyl, 2-hydroxyethyl or 2-chloroethyl group and $R_2$ represents methyl, ethyl, benzyl or phenyl group) and polycarbonate. As the exemplary substituent attached to X in the general formula I can be enumerated halogen. As the exemplary substituent attached to $Ar_1$ can be enumerated halogen, $C_1$–$C_4$ alkyl, $C_1$–$C_4$ alkoxy, dialkylamino (whose each alkyl has 1 to 4 carbon atoms), cyano, carboxyl, nitro or sulfo group. As the exemplary substituent attached to $Ar_2$ and $Ar_3$ can be enumerated nitro, sulfoamino, sulfo, halogen, $C_1$–$C_4$ alkyl, $C_1$–$C_4$ alkoxy, cyano, dialkylamino (whose each alkyl has 1 to 4 carbon atoms) or acylamino (whose each alkyl has 1 to 4 carbon atoms) group. And the lower alkyl group represented by $R_1$, $R_2$ and $R_3$ suitably has 1 to 4 carbon atoms. Further, as the exemplary substituent for the phenyl group represented by $R_1$ and $R_3$ can be enumerated halogen. Still further, the alkyl group of the carbonic acid alkyl ester suitably has 1 to 4 carbon atoms.

As the exemplary disazo pigments expressed by the general formula I can be enumerated the following:

| Compound No. | |
|---|---|
| 1. | 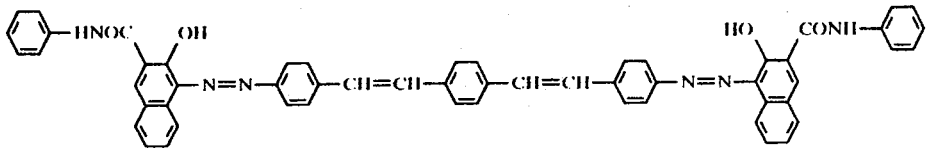 |
| 2. | 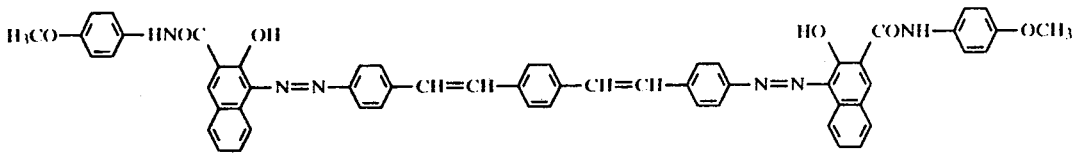 |
| 3. | 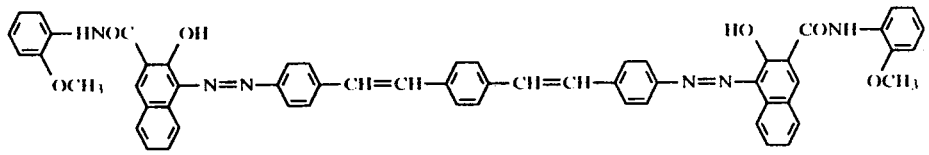 |
| 4. | 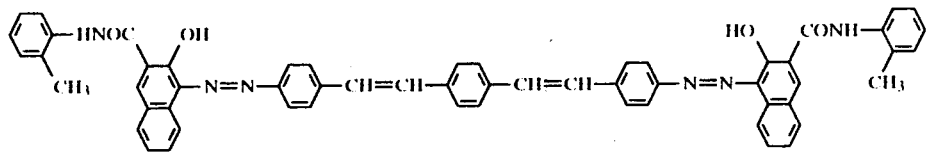 |
| 5. | 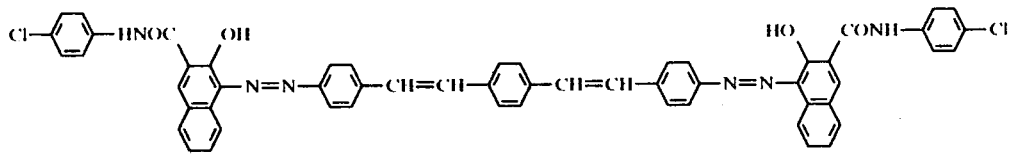 |
| 6. | 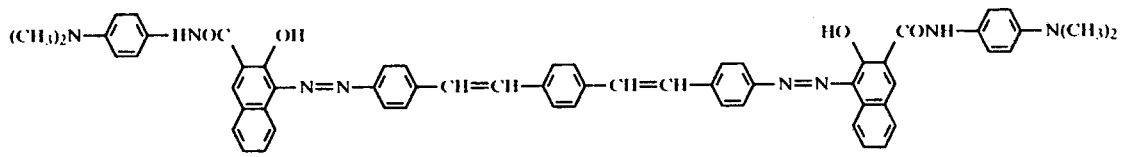 |
| 7. | 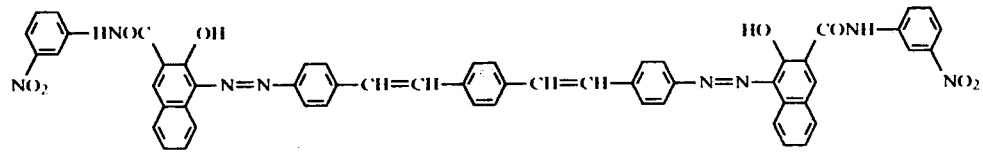 |
| 8. | 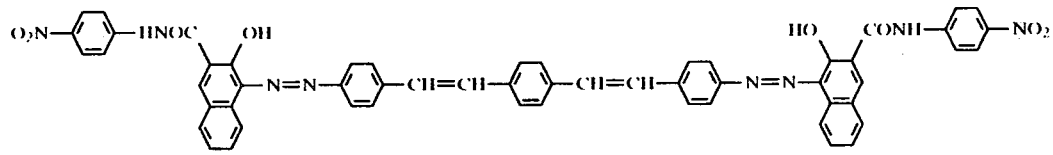 |
| 9. | 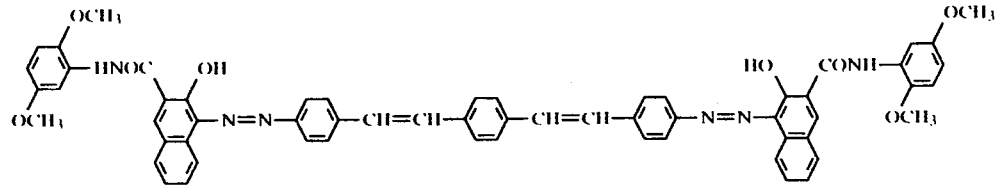 |
| 10. | 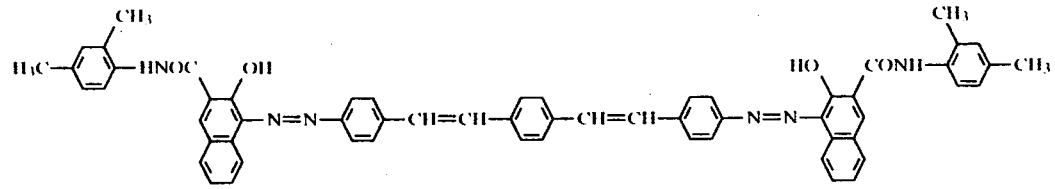 |

-continued

| Compound No. | |
|---|---|
| 11. | 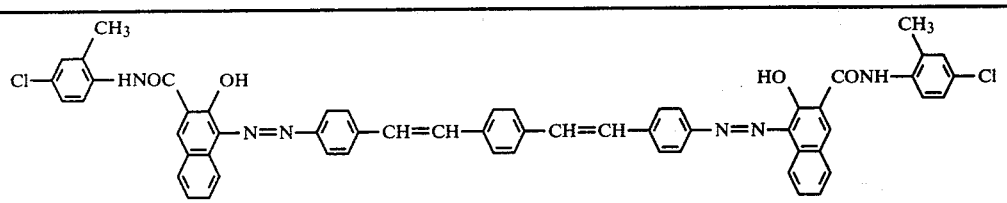 |
| 12. | 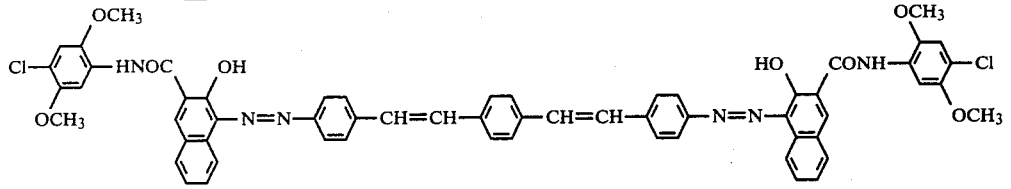 |
| 13. | 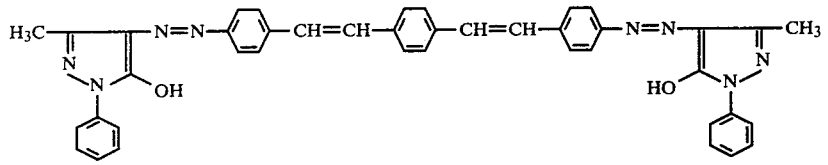 |
| 14. | 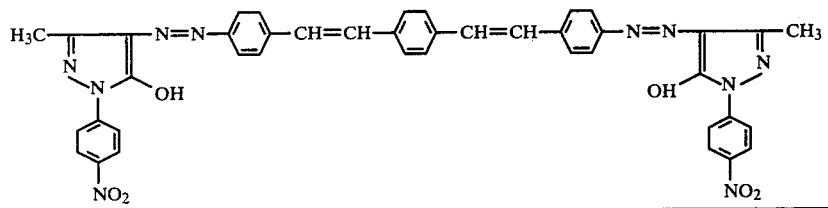 |

These disazo pigment type charge generating agents can be readily obtained through the steps of subjecting a starting material, 1,4-bis(4-aminostyryl)benzene to disazotation so as to isolate it as tetrazonium salt and thereafter subjecting the same to coupling reaction in the presence of suitable coupler and alkali in a suitable solvent, for instance, such as N,N-dimethylformamide. It is detailed in Japanese Patent Application No. 48859/1977 (U.S. Ser. No. 893,130).

The charge generating agent according to the present invention may be used singly or jointly with a normal binder. When it is used singly, the charge generating layer is normally formed by means of evaporation plating method. And when it is used jointly with a binder, the charge generating layer is normally formed by means of coating method. As the binders suitably used herein there can be enumerated condensation resins such as polyamide, polyurethane, polyester, epoxy resin, polyketone, polycarbonate, and the like and vinyl copolymers such as polyvinyl ketone, polystyrene, poly-N-vinylcarbazole, polyacrylamide and the like. However, it is to be noted that every insulating and adhesive resin may be employed. The amount of binder used herein suitably is in the range of from about 10 wt.% to about 200 wt.%, preferably in the range of from about 20 wt.% to 100 wt.% relative to the charge generating agent.

In any case, the suitable thickness of the thus formed charge generating layer is in the range of from about 0.04μ to about 20μ, preferably in the range of from about 0.05μ to 2μ. On the other hand, the charge transfer agent expressed by the general formula II used in the charge transfer layer may be readily obtained by effecting a reaction between the aldehyde derivative of carbazole and the hydrazine derivative thereof in a suitable solvent (for instance, dimethylformamide). As exemplary charge transfer agents used herein, the following compounds can be enumerated:

| Compound No. | |
|---|---|
| (1) | 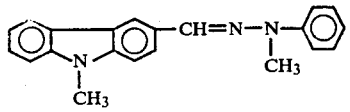 9-methylcarbazole-3-carbaldehyde-1-methyl-1-phenylhydrazone |
| (2) | 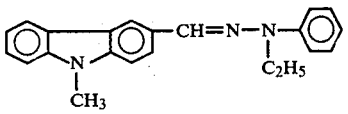 9-methylcarbazole-3-carbaldehyde-1-ethyl-1-phenylhydrazone |
| (3) | 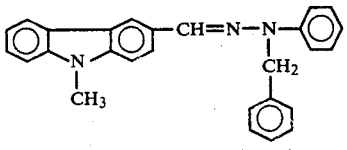 9-methylcarbazole-3-carbaldehyde-1-benzyl-1-phenylhydrazone |
| (4) | 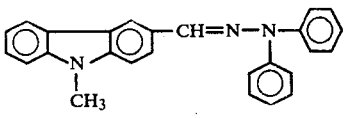 |

-continued

| Compound No. | |
|---|---|
| | 9-methylcarbazole-3-carbaldehyde-1,1-diphenylhydrazone |
| (5) | 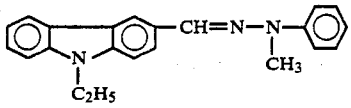 9-ethylcarbazole-3-carbaldehyde-1-methyl-1-phenylhydrazone |
| (6) | 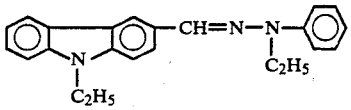 9-ethylcarbazole-3-carbaldehyde-1-ethyl-1-phenylhydrazone |
| (7) | 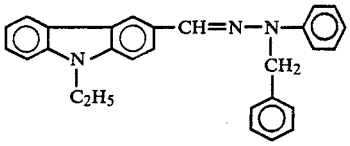 9-ethylcarbazole-3-carbaldehyde-1-benzyl-1-phenylhydrazone |
| (8) | 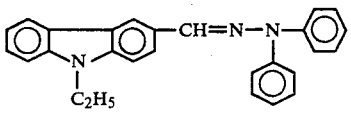 9-ethylcarbazole-3-carbaldehyde-1,1-diphenylhydrazone |
| (9) | 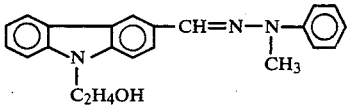 9-(β-hydroxyethyl)carbazole-3-carbaldehyde-1-methyl-1-phenylhydrazone |
| (10) | 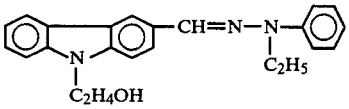 9-(β-hydroxyethyl)carbazole-3-carbaldehyde-1-ethyl-1-phenylhydrazone |
| (11) | 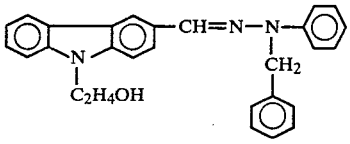 9-(β-hydroxyethyl)carbazole-3-carbaldehyde-1-benzyl-1-phenylhydrazone |
| (12) | 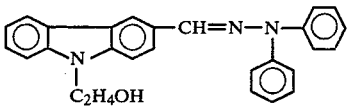 9-(β-hydroxyethyl)carbazole-3-carbaldehyde-1,1-diphenylhydrazone |
| (13) | 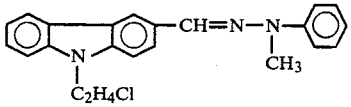 9-(β-chloroethyl)carbazole-3-carbaldehyde-1-methyl-1-phenylhydrazone |

-continued

| Compound No. | |
|---|---|
| (14) | 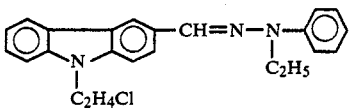 9-(β-chloroethyl)carbazole-3-carbaldehyde-1-ethyl-1-phenylhydrazone |
| (15) | 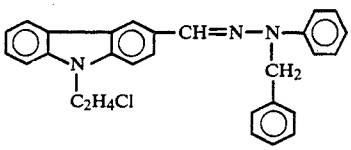 9-(β-chloroethyl)carbazole-3-carbaldehyde-1-methyl-1-phenyl hydrazone |
| (16) | 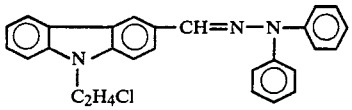 9-(β-chloroethyl)carbazole-3-carbaldehyde-1,1-diphenylhydrazone |

In the present invention, polycarbonate is utilized as the binder for use in said charge transfer agent. As mentioned above, the binder used in the charge transfer layer should be one capable of exerting influence upon not only the mechanical characteristics and physical properties but also electrostatic characteristics and durability of the layered electrophotographic element. In this regard it is to be noted that the binder used in the present invention is capable of fully meeting the above-enumerated performances. In particular, the binder according to the present invention is capable of exceedingly improving the surface uniformity of the element because it is of a superior compatibility with said charge transfer agent expressed by the general formula II and therefore does not bring about any crystallization.

The polycarbonate capable of satisfying the aforesaid requirement includes polycarbonate soluble in a low boiling hydrocarbon halide such as dichloroethane, methylenechloride or the like; polycarbonate soluble is an aromatic hydrocarbon such as toluene, xylene or the like; and polycarbonate soluble in alicyclic ethers such as tetrahydrofuran, dioxane or the like (which will be referred to as soluble polycarbonate hereinafter). This polycarbonate is expressed by the following formula:

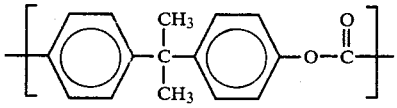

As the concrete examples of said polycarbonate there can be enumerated Lexan 131-III produced by General Electric Co., Upiron E-2000F and S-3000 produced by MITSUBISHI GAS KAGAKU K.K., and Panlite L-1250, C-1400 and KN-1300 produced by TEIJIN K.K. In connection with said Panlite KN-1300, its particulars are unknown, but is identified as a chloro-substituted polycarbonate.

The formation of the charge transfer layer may be effected by coating a charge transfer agent- and polycarbonate-containing solution, as described above, onto the charge generating layer formed on the electroconductive support and drying. The ratio of the charge transfer agent to the polycarbonate is normally in the range of from about 1/10 to 40/10 (by weight), practically it is preferred to be in the range of from about 4/10 to 20/10. If the aforesaid ratio is within this range there may be formed a stiff, uniform film. Furthermore, another binder such as acrylic resin, polyvinylidene chloride, polyvinyl chloride, chlorinated rubber or the like may be added to the charge transfer layer in an amount up to about 30 wt.% relative to the polycarbonate for the purpose of improving the adhesive property and repetition characteristic thereof. The thus formed charge transfer layer is suitable to have a thickness in the range of from about 3μ to about 50μ, preferably in the range of from about 8μ to 25μ.

DESCRIPTION OF THE PREFERRED EMBODIMENTS

Hereinafter will be given Examples embodying the present invention. Every part used herein is part by weight.

EXAMPLE 1

2 parts of a charge generating agent (compound expressed by the structural formula,

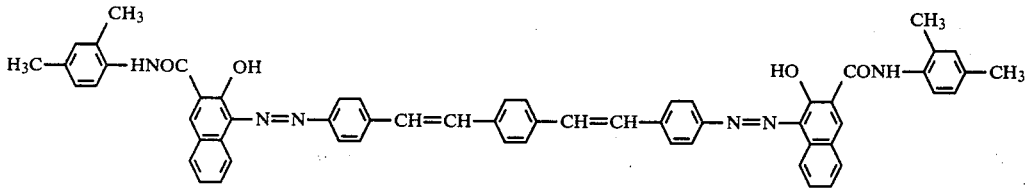

No. 10 disazo pigment), 1 part of a polyvinyl butyral/polymethylmethacrylate=3/7 (weight) mixture and 30 parts of tetrahydrofuran were milled in a ball mill for 3 hours. The resulting dispersion was coated onto an aluminum evaporation-plated polyester film by means of a doctor blade and dried, thereby forming an about 0.3 μm-thick charge generating layer. Thereon was likewise coated a solution consisting of 10 parts of the charge transfer agent expressed by the general formula II wherein $R_1$ represents ethyl group and $R_2$ represents methyl group (9-ethylcarbazole-3-carbaldehyde-1-methyl-1-phenylhydrazone); 10 parts of polycarbonate (Panlite K-1300 produced by TEIJIN KASEI K.K.) and 80 parts of tetrahydrofuran and dried, thereby forming an about 13 μm-thick charge transfer layer. A layered electrophotographic element was thus prepared.

Comparative Examples 1 through 17

A layered electrophotographic element was prepared by repeating the same procedure as Example 1 except that two kinds of thermoplastic polyesters (Vylon 200 and U-polymer), polyvinylidene chloride, chlorinated rubber, polyvinyl toluene, styrene-maleic anhydride copolymer, polystyrene, polyvinyl butyral, styrene-butadiene copolymer, polyvinyl chloride, vinyl chloride-vinyl acetate copolymer, thermoplastic polyurethane, polymethyl methacrylate, ethyl cellulose, polyamide or chlorosulfonated polyethylene was employed as the binder used jointly with the charge transfer agent.

EXAMPLE 2

A layered electrophotographic element was prepared by repeating the same procedure as Example 1 except that the compound expressed by the general formula II wherein $R_1$ represents ethyl group and $R_2$ represents benzyl group (9-ethylcarbazole-3-carbaldehyde-1-benzyl-1-phenylhydrazone) was employed as the charge transfer agent.

Comparative Example 18

A layered electrophotographic element was prepared by repeating the same procedure as Example 2 except that polystyrene was employed as the binder used jointly with the charge transfer agent.

Next, the thus obtained electrophotographic elements were subjected to −6 KV corona discharge for 20 seconds by means of a commercially available paper analyzer (produced by KAWAGUTI DENKI K.K.) for electrification, the surface potential Vs at this time being measured, the same was successively left standing in a dark for 20 seconds, the surface potential Vo being measured again, and thereafter it was exposed to radiation of tungsten lamp light for 30 seconds at a surface illumination intensity of 20 lux, thereby releasing the charged electricity. The surface potential at this time will be called V30. Next, measurement was made on the amount of exposure E1/10 required for 1/10 decay of Vo. And the cycle of −6 KV electrification-exposure-electricity removal (radiation of 20 lux tungsten lamp light) was repeated 5000 times on the same elements respectively to thus measure the amount of decreased potential (ΔVo) and the amount of increased potential (ΔVr) after release of the charged electricity from the initial charged potential Vo and the surface potential after 5000 times repetition of said cycle, and the repetition characteristics of the above elements were evaluated therefrom. In addition, the aforesaid elements were left standing in an air conditioning equipment having a temperature of 70° C. and a relative humidity of 30% for 7 days, and thereafter were taken out to measure the compatibility of binder with charge transfer agent by observing whether charge transfer agent crystals were separated or not from their surface. And their surface uniformities were evaluated based thereon. The thus obtained results are as shown in the following table.

| | Kind of binder in charge transfer layer | Electrostatic characteristics Vs (volt) | Vo/Vs | El/10 (lux . sec) | $V_{30}$ (volt) | Repetition characteristics of element ΔVo (volt) | ΔVr (volt) | Surface property | Remarks |
|---|---|---|---|---|---|---|---|---|---|
| Example 1 | Soluble polycarbonate | 1089 | 0.88 | 5.3 | 0 | −100 | +15 | o | Stiff |
| Comparative Example 1 | Polyester (Vilon 200) | 1137 | 0.89 | 5.8 | 0 | −80 | +220 | x | Blocking occurred |
| Comparative Example 2 | Polyester (U-polymer) | 1282 | 0.85 | 6.7 | 15 | −50 | +210 | o | — |
| Comparative Example 3 | Polyvinylidene chloride | 143 | 0.28 | 3.2 | 0 | — | — | o | — |
| Comparative Example 4 | Chlorinated rubber | 606 | 0.34 | 3.9 | 0 | −500 | 0 | o | — |
| Comparative Example 5 | Polyvinyl toluene | 1270 | 0.76 | 5.3 | 12 | −130 | +100 | x | — |
| Comparative Example 6 | Styrene~ maleic anhydride | 503 | 0.14 | — | — | — | — | Δ | White turbidity |
| Comparative Example 7 | Polystyrene | 1190 | 0.77 | 5.0 | 2 | −150 | +20 | o | Brittle |
| Comparative Example 8 | Polyvinyl butyral | 1400 | 0.86 | 6.9 | 13 | −130 | +100 | Δ | — |
| Comparative Example 9 | Styrene~ butadiene | 1217 | 0.80 | 5.4 | 3.9 | −140 | +50 | x | — |
| Comparative Example 10 | Polyvinyl chloride | 1152 | 0.84 | 6.0 | 0 | −150 | −40 | o | — |
| Comparative Example 11 | Vinyl chloride~ vinyl acetate | 1422 | 0.87 | 10.4 | 36 | −160 | −60 | o | — |
| Comparative Example 12 | Polyurethane | 1273 | 0.82 | 7.4 | 8.8 | −200 | +100 | x | — |
| Comparative Example 13 | Polymethyl methacrylate | 1316 | 0.75 | 7.4 | 20 | −120 | 0 | Δ | Brittle |
| Comparative Example 14 | Ethyl cellulose | 1549 | 0.78 | — | — | — | — | x | White turbidity |
| Comparative Example 15 | Polyamide | 1873 | 0.92 | — | — | — | — | x | White turbidity |
| Comparative Example 16 | Chlorosulfonated polyethylene | 1223 | 0.85 | 7.2 | 0 | −370 | −60 | Δ | — |
| Comparative Example 17 | Polybutyl acrylate | 1300 | 0.80 | 7.5 | 25 | −130 | +90 | Δ | — |
| Example 2 | Soluble polycarbonate | 1100 | 0.82 | 6.0 | 0 | −50 | +25 | o | Stiff |
| Comparative Example 18 | Polystyrene | 1200 | 0.80 | 6.5 | 0 | −100 | +60 | o | Brittle |

Note
o : No crystals separated
Δ: Crystals separated a little
x : Crystals separated much

EXAMPLE 3 THROUGH 8

Layered electrophotographic elements were prepared by repeating the same procedure as Example 1 except that the other polycarbonates as shown in the following table were employed in lieu of the polycarbonate (Panlite K 1300) produced by TEIJIN KASEI K.K.) according to Example 1.

| Example | Grade | Maker | Vs (volt) | Vo/Vs | El/10 (lux sec) | $V_{30}$ (volt) | ΔVo (volt) | ΔVr (volt) | Surface property |
|---|---|---|---|---|---|---|---|---|---|
| 3 | Lexan 131-III | GE | 1233 | 0.831 | 5.3 | 4.9 | −40 | +15 | o |
| 4 | Upiron E-2000F | MITSUBISHI GAS | 1111 | 0.903 | 5.4 | 3.9 | −25 | +20 | o |

-continued

| Example | Grade | Maker | Vs (volt) | Vo/Vs | El/10 (lux sec) | $V_{30}$ (volt) | ΔVo (volt) | ΔVr (volt) | Surface property |
|---|---|---|---|---|---|---|---|---|---|
| 5 | Upiron S-3000 | KAGAKU | 1161 | 0.852 | 5.2 | 2.0 | −40 | +20 | o |
| 6 | Panlite L-1250*1 | | 1108 | 0.851 | 5.3 | 0 | −40 | +20 | o |
| 7 | Panlite C-1400*2 | TEIJIN | 1075 | 0.873 | 5.3 | 0 | −50 | +15 | o |
| 8 | Panlite KN-1300*3 | | 998 | 0.855 | 5.1 | 0 | −55 | +10 | o |

*1Molecular weight 25,000

*2Molecular weight 40,000

*3Chloro-substituted polycarbonate whose molecular weight is 30,000.

What is claimed is:

1. A layered electrophotographic element which comprises an electroconductive support on which there is a charge generating layer and a charge transfer layer in order, said charge generating layer consisting essentially of a charge generating agent expressed by the general formula I

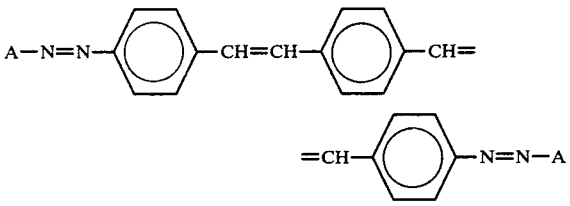

wherein A represents

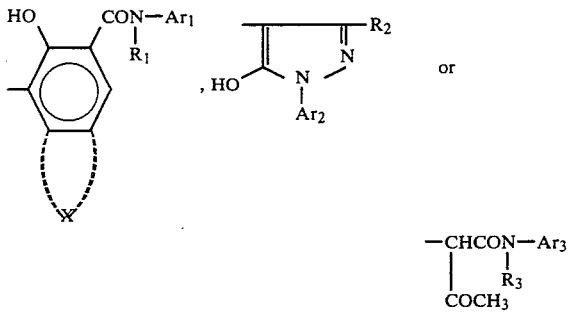

wherein X is selected from the group consisting of benzene ring, naphthalene ring, indole ring, carbazole ring, benzofuran ring and substitutes thereof, $Ar_1$ is selected from the group consisting of benzene ring, naphthalene ring, dibenzofuran ring, carbazole ring and substitutes thereof, $Ar_2$ and $Ar_3$ are selected from the group consisting of benzene ring, naphthalene ring and substitutes thereof, $R_1$ and $R_3$ are selected from the group consisting of hydrogen, lower alkyl group, phenyl group and substitutes thereof and $R_2$ is selected from the group consisting of lower alkyl group, carboxyl group and alkyl esters thereof, said charge transfer layer consisting essentially of a charge transfer agent expressed by the general formula II

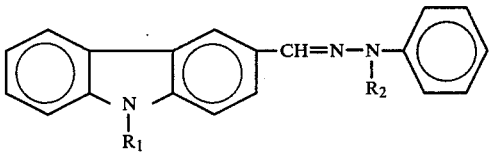

wherein $R_1$ represents methyl, ethyl, 2-hydroxyethyl or 2-chloroethyl group and $R_2$ represents methyl, ethyl, benzyl or phenyl group and polycarbonate.

2. The layered electrophotographic element according to claim 1 wherein the ratio of the charge transfer agent to the polycarbonate is in the range of from about 1/10 to 40/10 by weight.

3. The layered electrophotographic element according to claim 1 wherein the ratio of the charge transfer agent to the polycarbonate is in the range of from about 4/10 to 20/10 by weight.

4. The layered electrophotographic element according to claim 1 wherein the thickness of the charge generating layer is in the range of from about 0.04μ to 20μ, and the thickness of the charge transfer layer is in the range of from about 3μ to 50μ.

5. The layered electrophotographic element according to claim 1 wherein the thickness of the charge generating layer is in the range of from about 0.05μ to 2μ, and the thickness of the charge transfer layer is in the range of from about 8μ to 25μ.

6. The layered electrophotographic element according to claim 1 wherein the binder for use in the charge transfer layer is polycarbonate soluble in a solvent selected from the group consisting of low boiling hydrocarbon halide, aromatic hydrocarbon and alicyclic ether.

7. The layered electrophotographic element according to claim 1 wherein the binder for use in the charge transfer layer is a polycarbonate soluble in a solvent selected from the group consisting of dichloroethane, methylene chloride, toluene, xylene, tetrahydrofuran and dioxane.

8. The layered electrophotographic element according to claim 1 wherein the charge generating agent is selected from the group consisting of the following compounds:

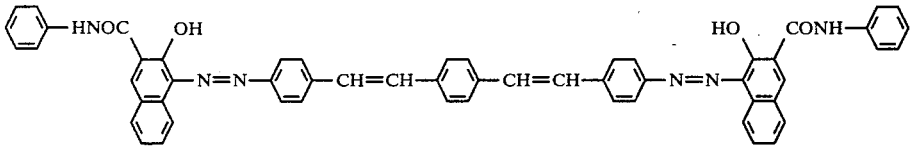

-continued
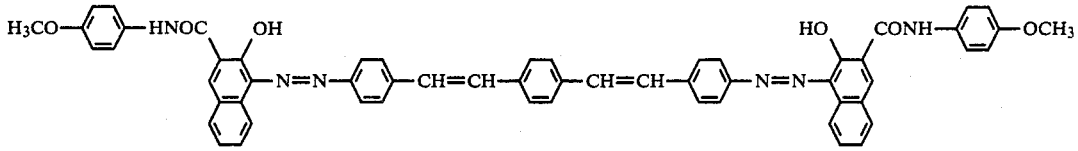
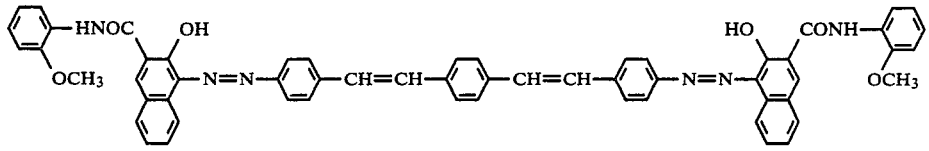
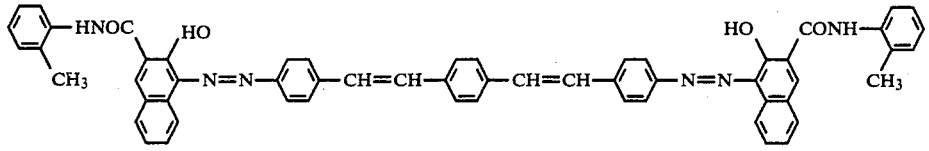
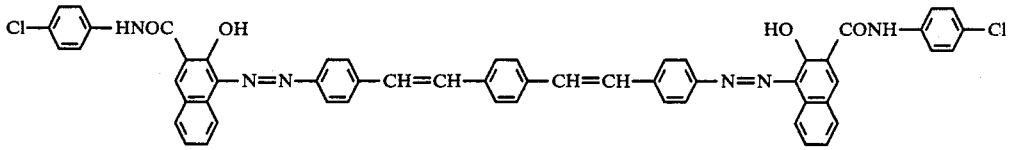
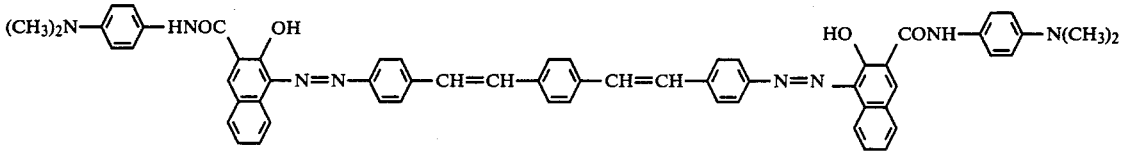
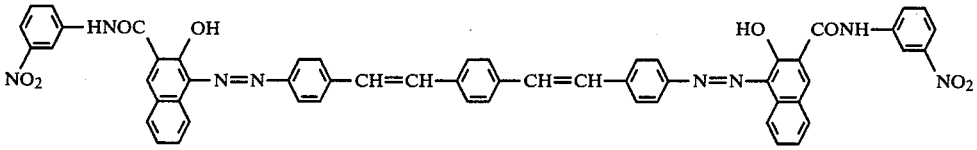
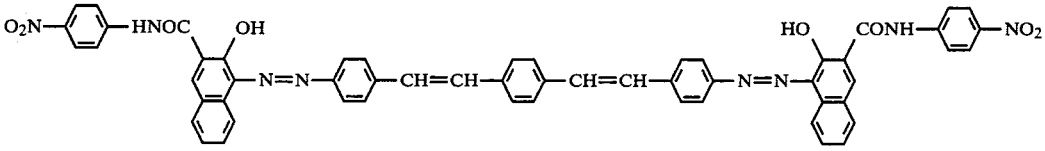
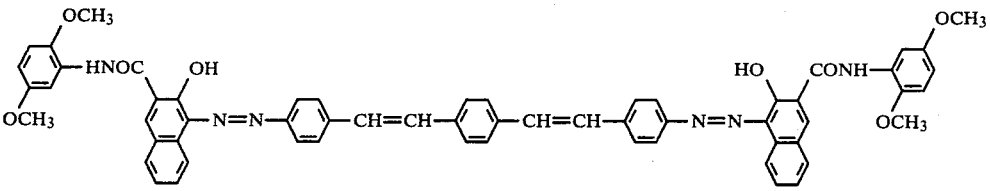
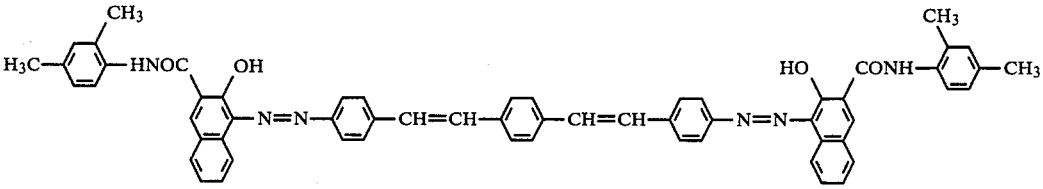
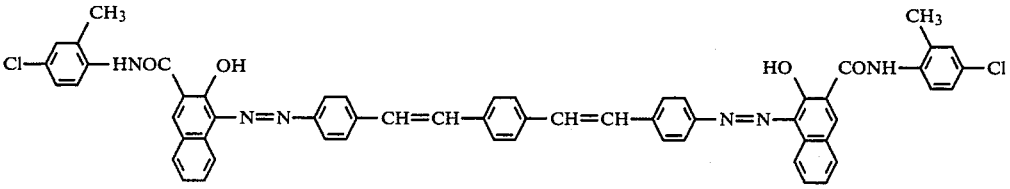

-continued
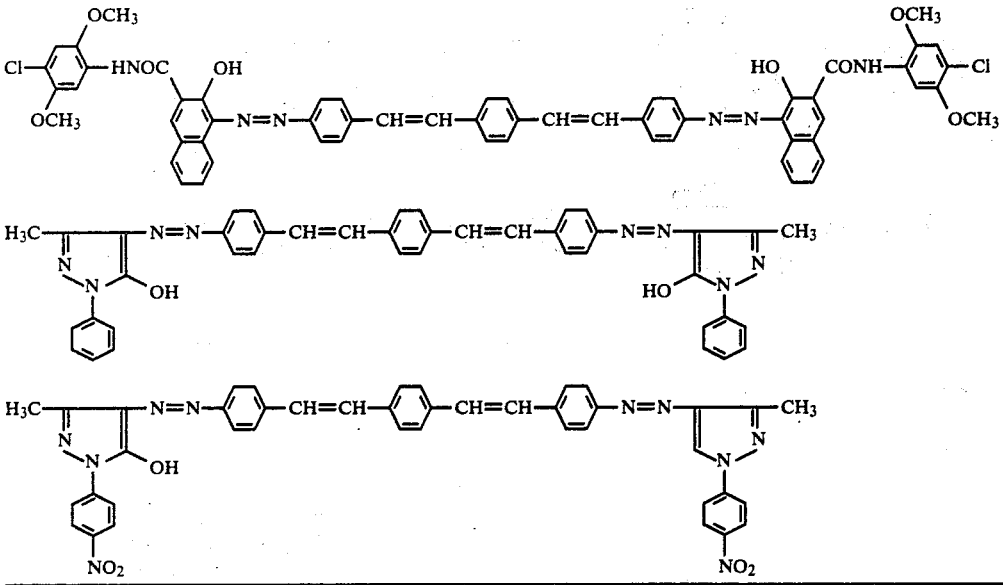
9. The layered electrophotographic element according to claim 1 wherein the large generating agent is
-continued
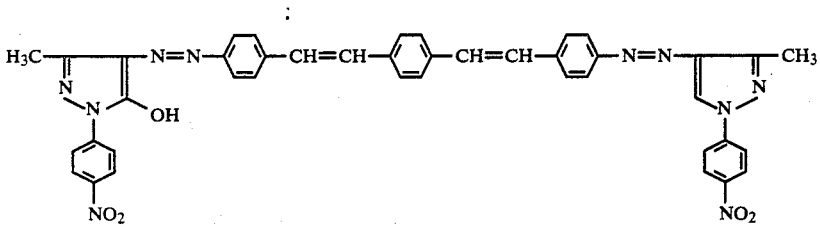
10. The layered electrophotographic element according to claim 1 wherein the charge transfer agent is a member selected from the group consisting of
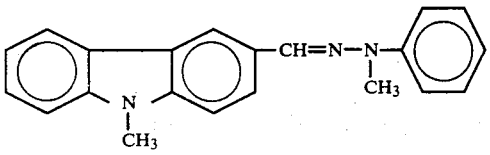
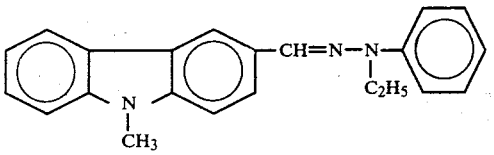
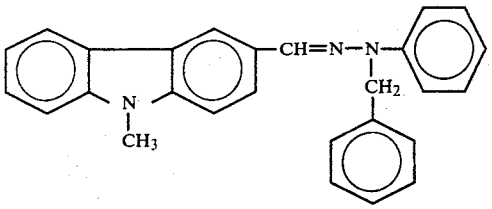
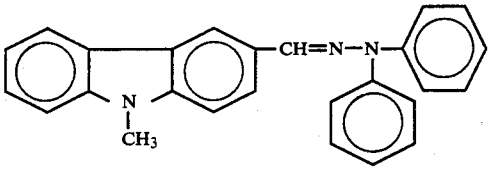
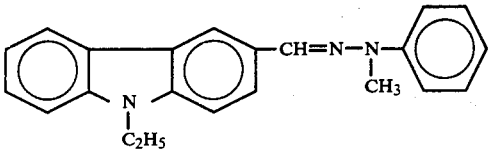
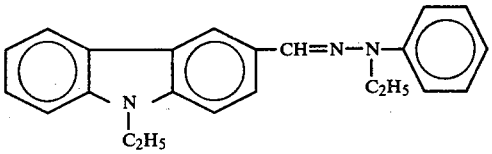
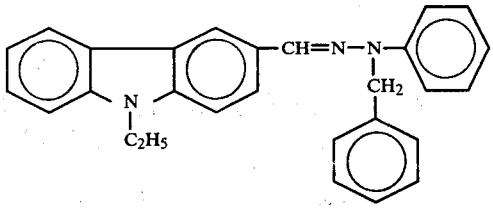

-continued

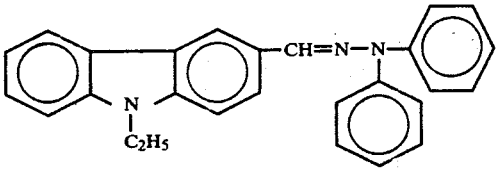

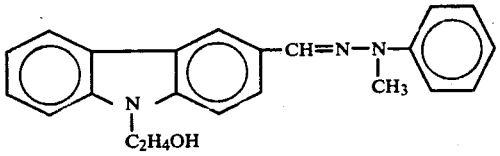

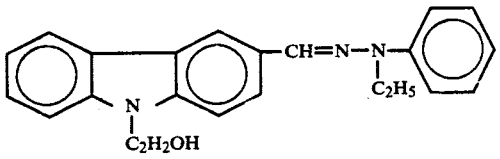

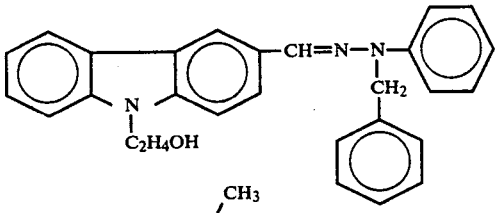

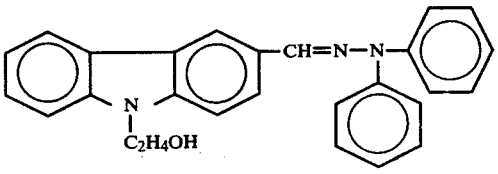

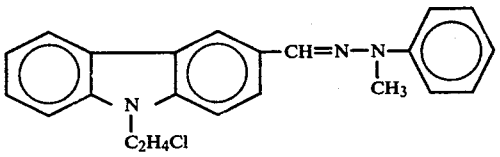

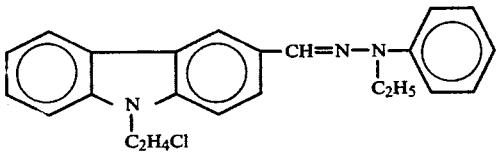

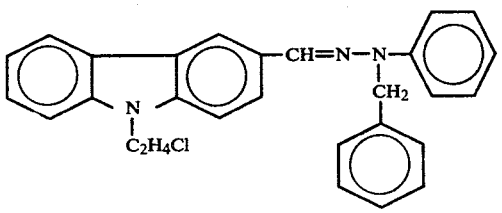

-continued

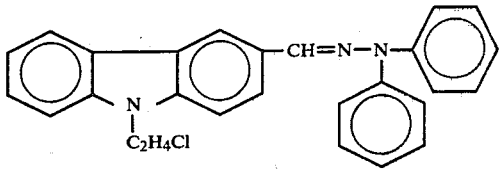

11. The layered electrophotographic element according to claim 1 wherein the charge transfer agent is

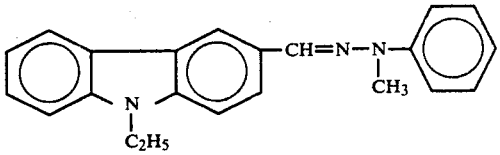

12. An electrophotographic element which comprises an electroconductive support on which there is, in the following order, a charge generating layer containing therein a charge generating agent expressed by the formula

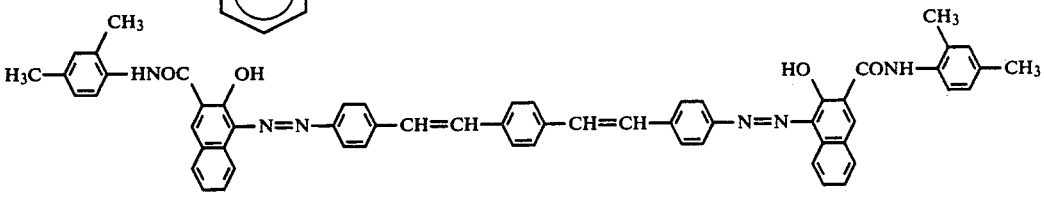

and a charge transfer layer consisting essentially of a charge transfer agent expressed by the formula

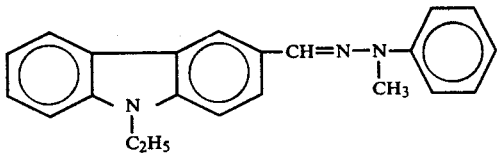

and polycarbonate.

13. An electrophotographic process comprising the steps of charging and image-wise exposing light onto an electrophotographic element, said element comprising an electroconductive support on which there is in order a charge generating layer and a charge transfer layer, said charge generating layer being consisted essentially of a charge generating agent expressed by the general formula I

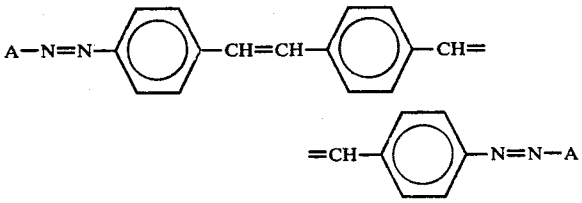

wherein A represents

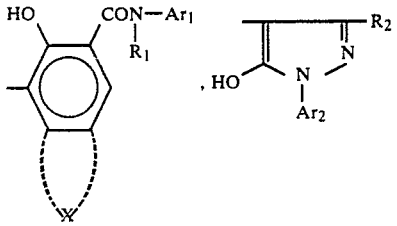

or

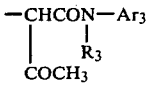

wherein X is selected from the group consisting of benzene ring, naphthalene ring, indole ring, carbazole ring, benzofuran ring and substitutes thereof, $Ar_1$ is selected from the group consisting of benzene ring, naphthalene ring, dibenzofuran ring, carbazole ring and substitutes thereof, $Ar_2$ and $Ar_3$ are selected from the group consisting of benzene ring, naphthalene ring and substitutes thereof, $R_1$ and $R_3$ are selected from the group consisting of hydrogen, lower alkyl group, phenyl group and substitutes thereof and $R_2$ is selected from the group consisting of lower alkyl group, carboxyl group and alkyl esters thereof, said charge transfer layer consisting essentially of a charge transfer agent expressed by the general formula II

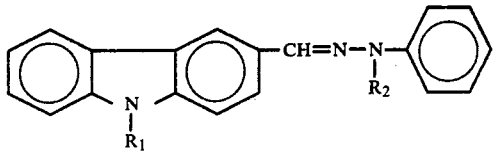

wherein $R_1$ represents methyl, ethyl, 2-hydroxyethyl or 2-chloroethyl group and $R_2$ represents methyl, ethyl, benzyl or phenyl group and polycarbonate.

14. The electrophotographic process according to claim 13 wherein the charge transfer agent is

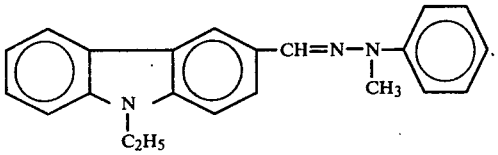

15. The electrophotographic process according to claim 13 wherein the charge generating agent is

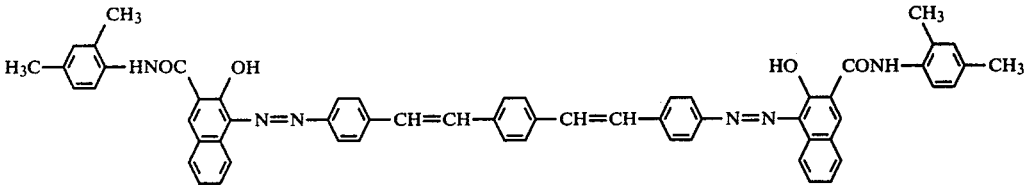

and the charge transfer agent is

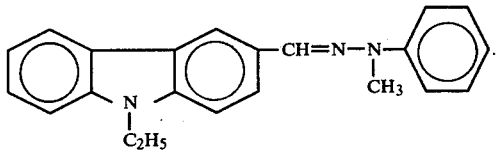

* * * * *

UNITED STATES PATENT AND TRADEMARK OFFICE

CERTIFICATE OF CORRECTION

PATENT NO. : 4 256 821

DATED : March 17, 1981

INVENTOR(S) : Takamichi Enomoto et al

It is certified that error appears in the above—identified patent and that said Letters Patent is hereby corrected as shown below:

Column 17, Claim 9, line 2; change "large" to ---charge---.

Claim 9, line 3, the formula should read as follows:

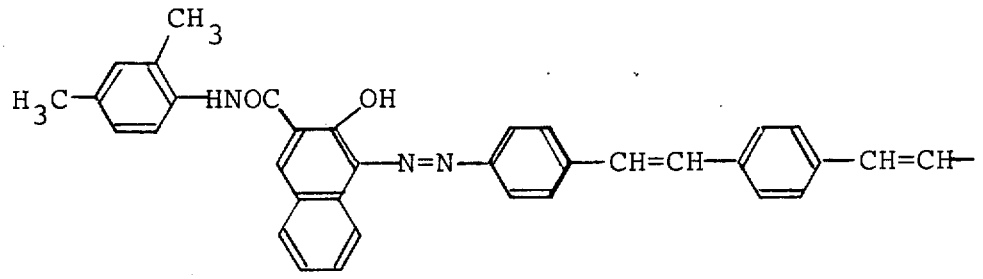

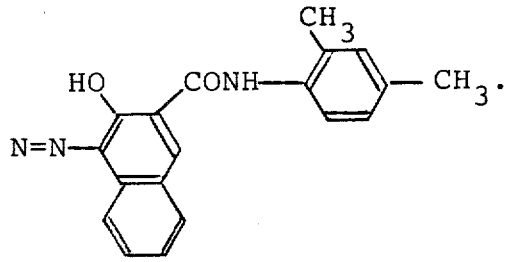

Column 20, Claim 13, line 53; change "is in order" to ---is, in the following order,---.

Column 20, Claim 13, line 55; change "being consisted" to ---consisting---.

UNITED STATES PATENT AND TRADEMARK OFFICE

CERTIFICATE OF CORRECTION

PATENT NO. : 4 256 821

DATED : March 17, 1981

INVENTOR(S) : Takamichi Enomoto et al

It is certified that error appears in the above—identified patent and that said Letters Patent is hereby corrected as shown below:

Claim 8, Columns 17 and 18, the third formula should read as follows:

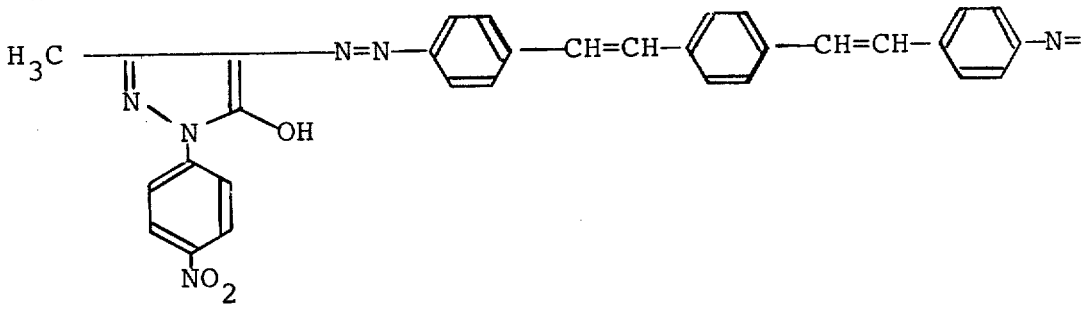

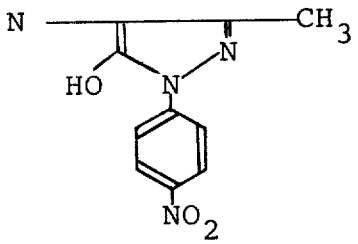

Signed and Sealed this

*Twenty-fifth* Day of *August 1981*

[SEAL]

*Attest:*

GERALD J. MOSSINGHOFF

*Attesting Officer*

*Commissioner of Patents and Trademarks*